US010396504B2

(12) United States Patent
Sichmann et al.

(10) Patent No.: US 10,396,504 B2
(45) Date of Patent: Aug. 27, 2019

(54) PLUG CONNECTION WITH A SHIELD SUPPORT AND A WALL BUSHING

(71) Applicant: Weidmüller Interface GmbH & Co. KG, Detmold (DE)

(72) Inventors: Wolfgang Sichmann, Hüttenberg (DE); Matthias Krug, Ruhla (DE)

(73) Assignee: Weidmüller Interface GmbH & Co. KG (DE)

( * ) Notice: Subject to any disclaimer, the term of this patent is extended or adjusted under 35 U.S.C. 154(b) by 0 days.

(21) Appl. No.: 15/879,551

(22) Filed: Jan. 25, 2018

(65) Prior Publication Data

US 2018/0219333 A1 Aug. 2, 2018

(30) Foreign Application Priority Data

Feb. 1, 2017 (DE) ..... 20 2017 100 530 U

(51) Int. Cl.

| | |
|---|---|
| ***H01R 13/74*** | (2006.01) |
| ***H01R 13/6594*** | (2011.01) |
| ***H01R 12/72*** | (2011.01) |
| ***H01R 13/6583*** | (2011.01) |
| ***H01R 13/518*** | (2006.01) |
| ***H01R 13/6587*** | (2011.01) |
| ***H01R 13/6599*** | (2011.01) |

(52) U.S. Cl.

CPC ..... *H01R 13/6594* (2013.01); *H01R 12/722* (2013.01); *H01R 13/518* (2013.01); *H01R 13/6583* (2013.01); *H01R 13/6587* (2013.01); *H01R 13/6599* (2013.01); *H01R 13/74* (2013.01)

(58) Field of Classification Search

CPC ..... H01R 13/6594; H01R 13/6599; H01R 13/6587; H01R 13/518; H01R 12/722; H01R 13/6583; H01R 13/74

See application file for complete search history.

(56) References Cited

U.S. PATENT DOCUMENTS

| | | | | | |
|---|---|---|---|---|---|
| 4,337,989 | A * | 7/1982 | Asick | H01R 13/6595 | 174/359 |
| 4,381,129 | A * | 4/1983 | Krenz | H01R 23/662 | 439/497 |
| 4,603,936 | A * | 8/1986 | Jagen | H01R 13/6592 | 439/354 |
| 4,678,121 | A * | 7/1987 | Douty | H01R 12/728 | 439/607.47 |
| 4,679,869 | A * | 7/1987 | Watson | H01R 13/518 | 439/78 |
| 5,149,275 | A * | 9/1992 | Pitta | H01R 23/662 | 439/497 |

(Continued)

*Primary Examiner* — Truc T Nguyen

(74) *Attorney, Agent, or Firm* — Laubscher & Laubscher, P.C.

(57) ABSTRACT

A plug connection assembly includes a wall with a wall bushing and a plug connection which penetrates the wall bushing. The plug connection includes a first plug connector on one side of the wall and a second plug connector connected with the first plug connector on a second side of the wall by plugging the first and second connectors together. The second plug connector is arranged on a printed circuit board and the first plug connector includes a shield support in the form of a shielding plate. The shield support is held in contact with the printed circuit board.

8 Claims, 5 Drawing Sheets

(56) References Cited

U.S. PATENT DOCUMENTS 5,775,924 A * 7/1998 Miskin ..... H01R 9/034 439/98
5,879,173 A * 3/1999 Poplawski ..... G02B 6/4246 439/138
6,095,862 A * 8/2000 Doye ..... H01R 13/6594 439/607.11
6,599,136 B2 * 7/2003 Sheldon ..... H01R 12/727 439/92
6,991,494 B1 * 1/2006 Spink, Jr. ..... H01R 13/745 439/607.27
2004/0127097 A1 * 7/2004 Korsunsky ..... H01R 13/652 439/607.01
2006/0079112 A1 * 4/2006 Shuey ..... H01R 13/6315 439/374
2008/0171455 A1 * 7/2008 Ko ..... H01R 13/6582 439/101
2010/0112859 A1 * 5/2010 Olawsky ..... H01R 12/712 439/607.01
2013/0164983 A1 * 6/2013 Ju ..... H01R 13/6581 439/607.55
2013/0244494 A1 * 9/2013 Tziviskos ..... H01R 13/405 439/676
2013/0288520 A1 * 10/2013 Simmel ..... H01R 13/502 439/607.01
2016/0043509 A1 * 2/2016 Reeves ..... H01R 13/631 439/374
2016/0149347 A1 * 5/2016 Hsu ..... H01R 13/6585 439/607.05
2016/0233615 A1 * 8/2016 Scholeno ..... H01R 12/712

* cited by examiner

PLUG CONNECTION WITH A SHIELD SUPPORT AND A WALL BUSHING

CROSS-REFERENCE TO EARLIER APPLICATIONS

This application claims priority of DE 20 2017 100 530.5 filed Feb. 1, 2017. The entire content of this application is incorporated herein by reference in their entirety

BACKGROUND OF THE INVENTION

Concerning the prior art, DE 2020 100 007 41 U1, EP 1 788 665 A2 and the EP 841 394 disclose various assemblies which provide plug connections.

The present invention was developed to provide a plug connection that can also be used on wall bushings through walls made of a nonconductive material such as a plastic.

SUMMARY OF THE INVENTION

According to a preferred embodiment, an assembly is provided for a wall with a wall bushing and with a plug connection for penetrating the wall bushing. The assembly includes a first plug connector on one side of the wall and a second plug connector plugged together with the first plug connector on a second side of the wall. The second plug connector is arranged on a printed circuit board and the first plug connector includes a shield support designed in the form of a shielding plate. The shield support is in contact with the printed circuit board. In this manner, a wall bushing having shielding potential can be formed in a simple manner on a wall made of an electrically nonconductive material such as nonconductive plastic.

From a structural point of view it is advantageous if, in the plugged together state of the two plug connectors, the shield support is in contact with a contact area of the printed circuit board on which the second plug connector is secured so that an electrically conductive connection between the printed circuit board and the shield support is provided. The shield support is in contact with a contact area on a first side of the printed circuit board via a contact arm. One or more stepped arms are guided towards the opposite second side of the printed circuit board in order to hold the printed circuit board and to form with the contact arm reaching under the printed circuit board a frictional connection unit with the printed circuit board. In this way, a plug connection is created in a simple manner in which the shield support includes at least one marginal area which reaches through a wall at a wall bushing and comes in direct contact with a conductive shield contact of the printed circuit board.

The plug connection may be in the form of an HDC plug connection. With the shield support, the plug connection can be easily handled and provides an excellent electrical contact with a printed circuit board through the contact spring when the connection is in a contact state.

To that extent, the plug assembly includes a first plug connector and a second plug connector plugged together with the first plug connector, wherein the second plug connector is arranged on a printed circuit board and the first plug connector has a shield support designed as a shielding plate. The shield support is in contact with the printed circuit board. This plug assembly also provides an excellent shielding transfer with or also without a wall.

BRIEF DESCRIPTION OF THE FIGURES

Other objects and advantages of the invention will become apparent from a study of the following specification when viewed with reference to the accompanying drawing in which.

DETAILED DESCRIPTION

Figure 1:
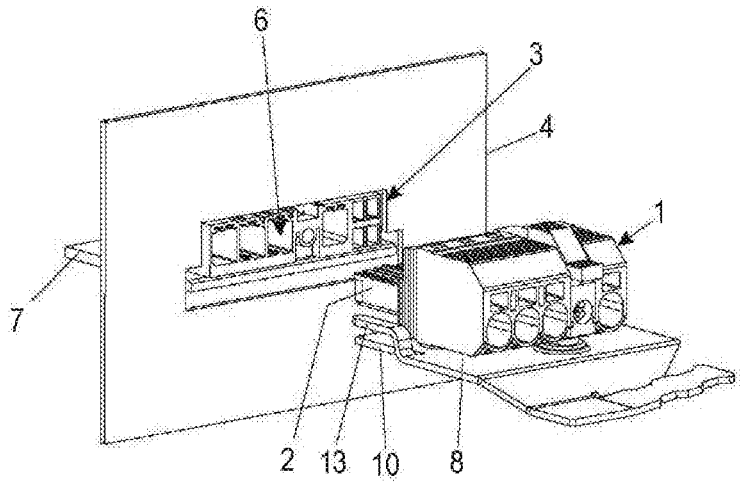
FIG. 1 is a top perspective view of an assembly with a wall, a wall bushing, and a first plug connector on a first side of the wall for coming in contact with a second plug connector arranged on the other side of the wall at the wall bushing in a separated state.
Figure 4C:
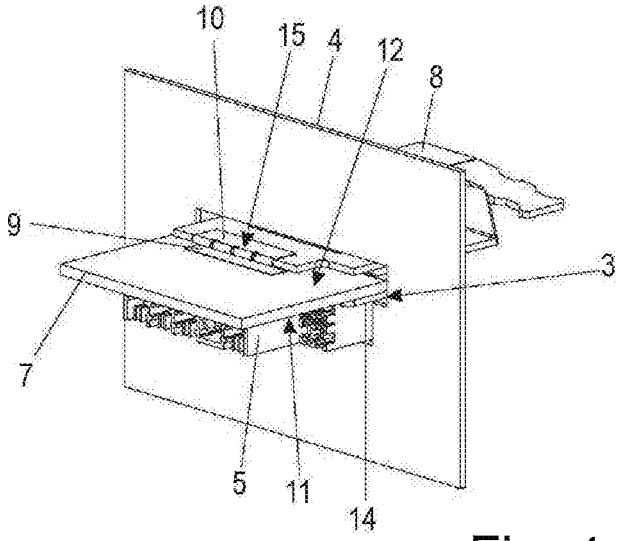
FIG. 4*c* is a bottom perspective view of the assembly of FIG. 4*a* mounted on a wall with the plug connectors in the connected state.
Figure 2A:
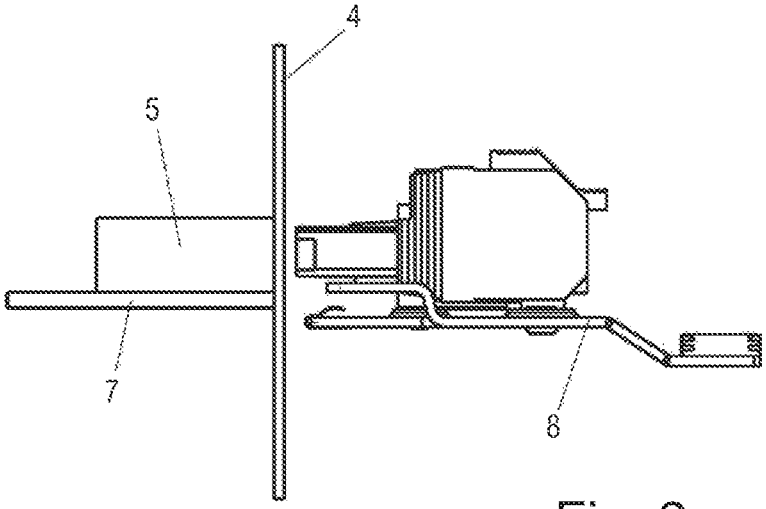
FIG. 2*a* is a side plan view of the assembly shown in FIG. 1 with the plug connectors in the not yet connected state.
Figure 3A:
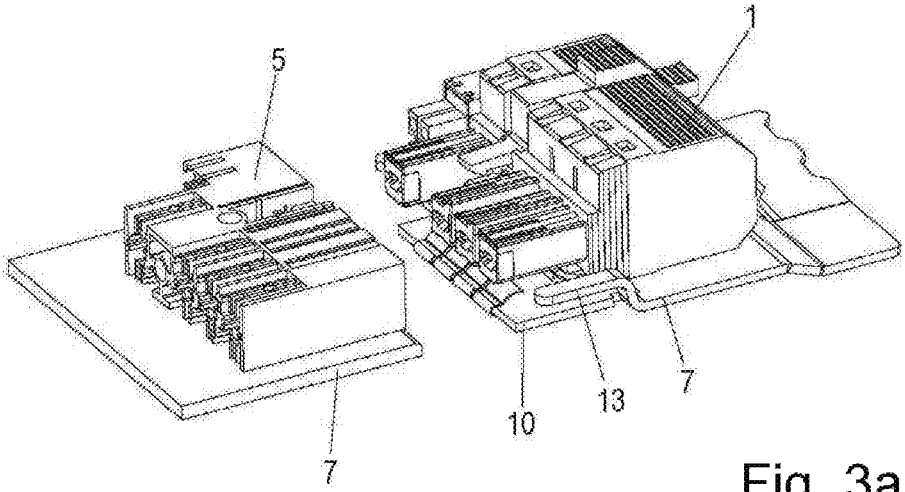
FIG. 3*a* is a top perspective view of the assembly shown in FIG. 1 without a wall with the plug connectors in the not yet connected state.
Figure 3B:
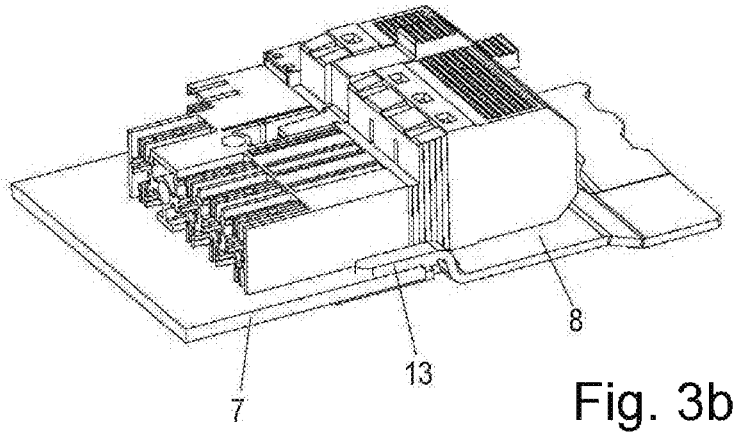
FIG. 3*b* is a top perspective view of the assembly of FIG. 3*a* with the plug connectors in the connected state.
Figure 4A:
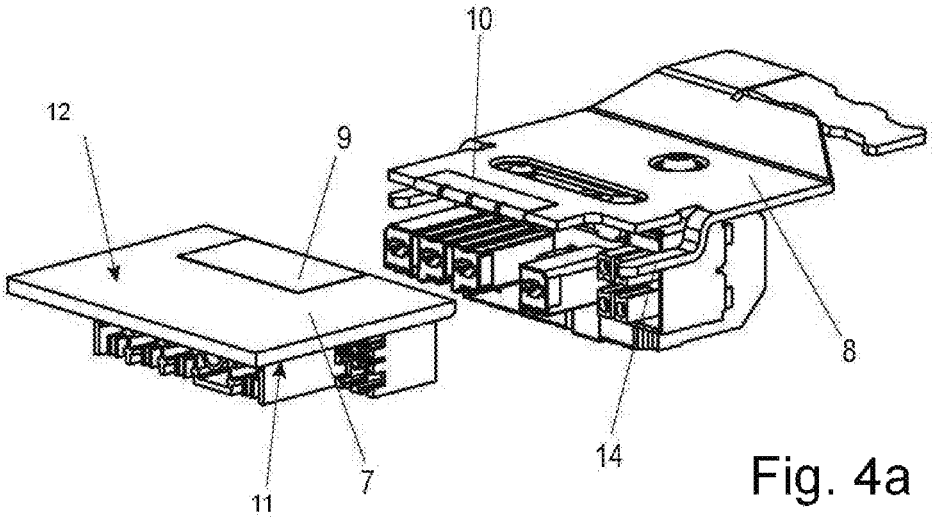
FIG. 4*a* is a bottom perspective view of the assembly shown in FIG. 1 without the wall with the plug connectors in the not yet connected state.

FIGS. 1 and 2 show in each case a plug connection assembly with a first plug connector 1 with first contacts 2 which is plugged on an opening or wall bushing 3 of a wall 4 such as a housing wall with a second plug connector 5 having corresponding contacts 6. FIGS. 3*a* and *b*, FIGS. 4*a* and *b* and FIGS. 5*a-c* 5 show the plug connection without the wall 4.

The wall 4 is preferably formed of an electrically non-conductive material, in particular of a non-conductive plastic.

The first plug connector 1 includes first plug socket or pin contacts 2 which are inserted into corresponding second plug socket or pin contacts 6 of the second plug connector 5. In the drawing, housing sections can be seen in which metal parts of the first and second plug contacts are inserted, but the actual metal parts of these contacts cannot be seen. The second plug connector 5 is a connector formed or arranged on a printed circuit board 7.

FIGS. 1 and 2 illustrate that the second plug connector 5 is secured on the wall 4, wherein the plug face of the plug connector 5 faces the wall bushing 3, while the first plug connector 1 is preferably connected to the end of a cable (not shown) with a cable shield.

The first plug connector 1 and an end area of the cable (not shown), are arranged on a shield support 8 of the first plug connector 1. The first plug connector is preferably secured to the shield support. The shield support 8 is a shielding plate formed of a conductive metal to which the cable shield of the cable (not shown) is applied to contact the shield. Although only one shield support is shown in the drawing, a plurality of shield supports may be provided.

Figure 2B:
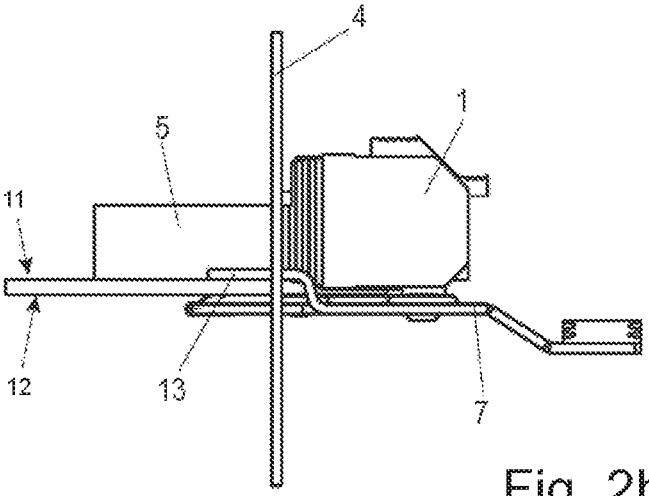
FIG. 2*b* is a side plan view of the assembly shown in FIG. 1 with the plug connectors in the connected state.

In contrast to prior plug connectors, in the connected state where the first and second plug connectors are plugged together as shown in FIGS. 1*b* and 2*b*, the shield support 8 is not in contact with the wall 4 in the area of the wall bushing 3 but with a shield contact area 9 of the printed circuit board 7 on which the second plug connector 5 is secured. In this manner, a direct electrically conductive connection between the printed circuit board 7 and the shield support 8 is achieved. Although only one contact area 9 is shown in the drawing, it will be understood by those of ordinary skill in the art that a plurality of contact areas may be provided for contact with a plurality of shield supports, respectively.

For this purpose, the shield support 8 can be in contact with the contact area 9 on a first side 11 of the printed circuit board 7 via at least one contact arm 10 which extends under the printed circuit board. On the contact arm 10, one or more contact springs 15 can be formed or provided which are spring-mounted in contact with the at least one contact area 9 of the printed circuit board 7 when the plug connectors are connected. The contact spring or springs 15 have a tolerance-compensating, effect in that they compensate for tolerances in the components of the plug connector assembly, particularly for tolerances of the pruned circuit board 7. In spite of these tolerances, the contact springs ensure a reliable and electrically conductive contact with the printed circuit board 7 or with the contact area(s) thereof.

Figure 5A:
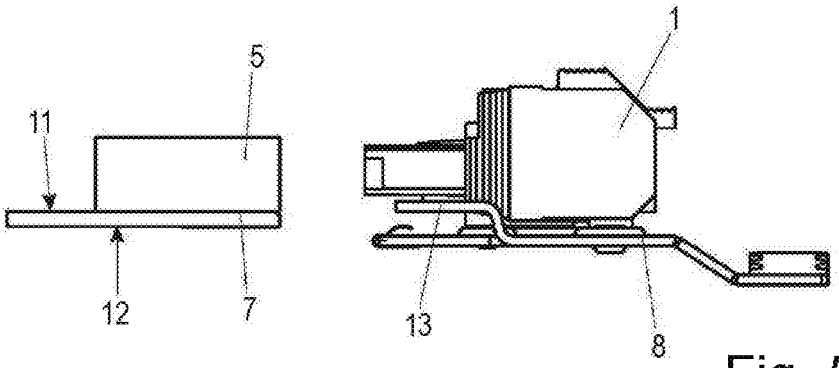
FIG. 5*a* is a side plan view of the assembly of FIG. 3*a* without a wall with the plug connectors in the not yet connected state.
Figure 5B:
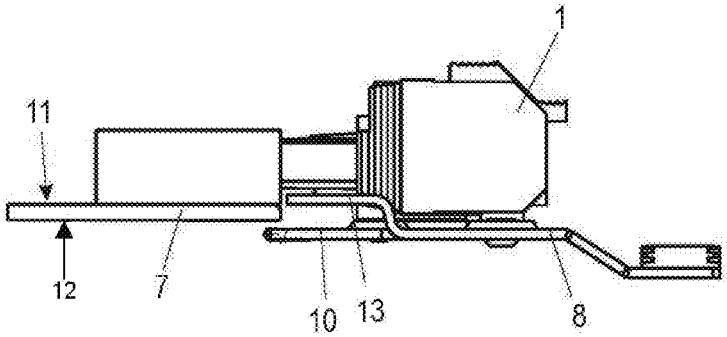
FIG. 5*b* is a side plan view of the assembly shown in FIG. 5*a* during connection of the plug connectors.
Figure 5C:
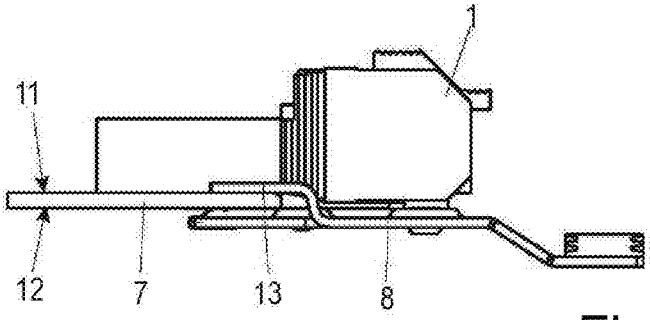
FIG. 5*c* is a side plan view of the assembly of FIGS. 5*a* and *b* with the plug connectors in the connected state.

One or more stepped or bent arms 13 are guided toward the first side 11 of the printed circuit board 7 in order to press the shield support 8 against the printed circuit board 7. In this manner, the shield support 8 is reliably spring-mounted in direct contact with the printed circuit board 7. According to a preferred embodiment, the stepped arms 13 extend from the outer edges of the shield support 8. Together with the contact arm 10 which reaches far under the printed circuit board 7 as shown in FIGS. 1, 2*b* and 5*c*, the stepped arms form a frictional connection with the printed circuit board 7 so that disadvantageous transverse forces on the plug connector 5 attached on the printed circuit board 7 (such as for example, by tilting one of the plug connections) are minimized or prevented.

Figure 4B:
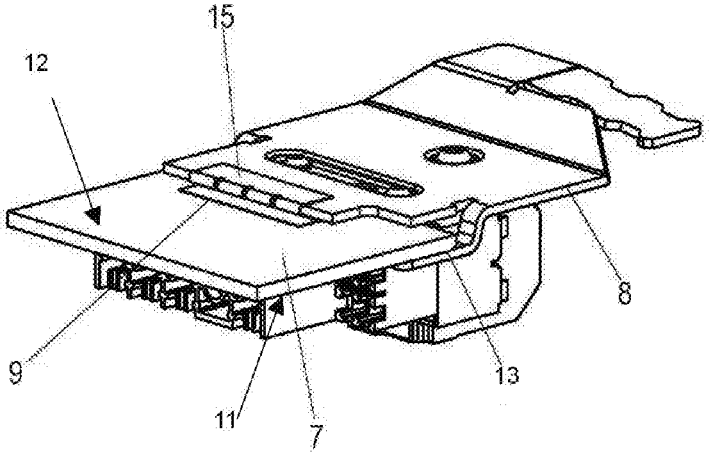
FIG. 4*b* is a bottom perspective view of the assembly of FIG. 4*a* with the plug connectors in the connected state.

The subject matter of the application is not limited to the above-described embodiment examples. In particular, it is also possible to reverse the orientation of the connectors and printed circuit boards. Such a reversal would appear as in FIGS. 4*a-c* when viewed in a top perspective view rather than a bottom perspective view.

The invention claimed is:

1. A plug connection assembly, comprising (a) a wall bushing arranged in a wall;

(b) a first plug connector arranged on one side of the wall and having a portion which extends through the wall bushing;

(c) a shield support configured as a shielding plate connected with and supporting said first plug connector;

(d) a second plug connector arranged on a side of the wall opposite said first plug connector and adapted for connection with said first plug connector via a plug connection; and (e) a printed circuit board connected with and supporting said second plug connector, said shield support contacting said printed circuit board when said first and second plug connectors are connected, said printed circuit board including a contact area on a first surface thereof; and wherein said shield support includes (i) at least one contact arm in contact with said contact area of said printed' circuit board; and (ii) at least one further arm guided toward a second side of said printed circuit board opposite said first side, said at least one contact arm and said at least one further arm defining a frictional connection and an electrically conductive connection with said printed circuit board when said first and second plug connectors are connected.

2. A plug connection assembly as defined in claim 1, wherein said shield support is in direct contact with said printed circuit board when said first and second plug connectors are connected.

3. A plug connection assembly as defined in claim 2, wherein the wall is formed of an electrically non-conductive material.

4. A plug connection assembly as defined in claim 1, wherein said at least one further arm has a stepped configuration.

5. A plug connection assembly as defined in claim 4, wherein said stepped arm extends from and edge of said shield support through said wall bushing.

6. A plug connection assembly as defined in claim 1, wherein said at least one contact arm includes at least one contact spring which is spring-mounted in contact with said contact area of said printed circuit board when said first and second plug connectors are connected.

7. A plug connection assembly as defined in claim 6, wherein said at least one contact spring compensates for tolerance in the connection between said contact arm of said shield support and said contact area of said printed circuit board.

8. A plug connection assembly, comprising (a) a first plug connector;

(b) a shield support configured as a shielding plate connected with and supporting said first plug connector;

(c) a second plug connector adapted for connection with said first plug connector via a plug connection; and (d) a printed circuit board connected with and supporting said second plug connector, said shield support contacting said printed circuit board when said first and second plug connectors are connected, said printed circuit hoard including a contact area on a first surface thereof; wherein said shield support includes (i) at least one contact arm in contact with said contact area of said printed circuit board; and (ii) at least one further arm guided toward a second side of said printed circuit board opposite said first side, said at least one contact arm and said at least one further arm defining a frictional connection and an electrically conductive connection with said printed circuit board when said first and second plug connectors are connected.

* * * * *